US006130955A

United States Patent [19]

Aigner et al.

[11] Patent Number: 6,130,955

[45] Date of Patent: Oct. 10, 2000

[54] VOICE COIL ASSEMBLY

[75] Inventors: Manfred Aigner; Gerhard Krump, both of Schwarzach, Germany

[73] Assignee: Harman Audio Electronic Systems GmbH, Straubing, Germany

[21] Appl. No.: 09/044,650

[22] Filed: Mar. 19, 1998

[30] Foreign Application Priority Data

Mar. 20, 1997 [DE] Germany ..... 197 11 592

[51] Int. Cl.[7] ..... H04R 25/00

[52] U.S. Cl. ..... 381/403; 381/400; 381/409

[58] Field of Search ..... 381/400, 401, 381/403, 406, 409, 410, FOR 154

[56] References Cited

U.S. PATENT DOCUMENTS

| | | | |
|---|---|---|---|
| 2,164,374 | 7/1939 | Barker | 381/405 |
| 5,014,323 | 5/1991 | Markow et al. | 381/194 |
| 5,249,236 | 9/1993 | Sakamoto | 381/194 |
| 5,641,910 | 6/1997 | Middleton | 73/668 |

OTHER PUBLICATIONS

Patent Abstracts of Japan and Japanese Patent Application J–288894, Sony Corp., Oct. 31, 1995.

*Primary Examiner*—Duc Nguyen
*Assistant Examiner*—Suhan Ni
*Attorney, Agent, or Firm*—Ware, Fressola, Van Der Sluys & Adolphson LLP

[57] ABSTRACT

Voice coil assemblies are designed so that the solder points which connect the coil wires and the stranded wires, are connected via a separate adhesive seam to the diaphragm or the voice coil carrier. According to the invention, the solder points are placed in the adhesive seam by which the centering membrane is connected to the voice coil carrier. The first region of the centering membrane is designed to be open in the direction of the voice coil. By locating the solder points in the adhesive seam a voice coil assembly is created which is distinguished by a low design height, a good current-carrying capacity and an excellent height reproduction.

5 Claims, 5 Drawing Sheets

VOICE COIL ASSEMBLY

BACKGROUND OF THE INVENTION

1. Technical Field

The invention pertains to the construction and manufacture of voice coil assemblies, where particular emphasis is placed on reducing the weight of such devices.

2. Description of the Prior Art

Voice coil assemblies customarily include a voice coil carrier, a voice coil, a centering membrane, and stranded wires. Customarily, the tubular voice coil carrier is connected to the voice coil. Axially spaced from the voice coil is a centering membrane that is also connected to the voice coil carrier by means of an adhesive seam. The centering membrane, which extends radially from the longitudinal extension of the voice coil carrier, has either an accordion-like or a corrugated contour, depending on the design. Each of the two voice coil wires of the voice coil is connected to one of the two stranded wires by a solder connection. To form the voice coil assemblies, which are often prefabricated for use in the manufacture of loudspeakers, essentially two manufacturing methods have been employed.

According to the first known method, the voice coil is first wound around the support and baked; the inside diameter of the neck of the loudspeaker membrane or diaphragm is then connected to the outer diameter of the voice coil carrier. After the connection of the diaphragm to the voice coil carrier, the voice coil wires are connected to the stranded input wires by solder connections. Once an adhesive bead is applied to the neck of the diaphragm, the centering membrane is pushed over the voice coil and adhered to the outer diameter of the neck of the diaphragm. If the solder points were not previously adhered to the diaphragm before the centering membrane was pushed on, they are now glued to the underside of the diaphragm.

According to another known method, first the voice coil is connected to the voice coil carrier and the voice coil wires are connected to the stranded wires at the solder points. The solder points are then adhered to the voice coil carrier. Next, the centering membrane is pushed from the end of the voice coil carrier, which is not connected to the diaphragm, onto the voice coil carrier and attached to the voice coil carrier by means of an adhesive seam which is located between the adhesion sites for the solder points and the voice coil. This process has the disadvantage, with respect to the first process, that a relatively large amount of adhesive is required for attachment of the centering membrane to the voice coil carrier.

This can be attributed to the fact that the centering membrane in the second process must have a relatively large inside diameter in order to prevent damage to the voice coil when pushing the centering membrane over the voice coil. In this process, it is not possible to push the centering membrane from the end of the voice coil carrier, which will be later joined to the diaphragm. Of course, a small inner diameter of the centering membrane is possible; however, this would mean that the centering membrane must be located between the solder points and the end of the voice coil carrier, which will later be joined to the diaphragm. Pushing the centering membrane with a smaller inside diameter farther downward over the solder points and then attaching it to the voice coil carrier is not possible since the smaller inside diameter would destroy or remove the attachment of the solder points to the voice coil carrier. Finally, the second method has the disadvantage, relative to the first method, that due to the additional placement of the solder points on the voice coil carrier, the joints must be completely adhesive-tight, in order to prevent the penetration of adhesive (which is needed for attachment of the solder points) to the inside of the voice coil carrier. This additional sealing will result in increased weight. To complete the voice coil assembly, according to the second method, the voice coil carrier will also be connected to the diaphragm. However, the connection of voice coil carrier and diaphragm can take place at a time when the voice coil carrier and the centering membrane are already mounted in a loudspeaker housing.

Whereas the first method requires a great deal of manual effort and thus is relatively labor-intensive compared to the other methods, vibration coil devices according to the other methods have the added disadvantage that due to the need for attachment of the solder points to the voice coil carrier, these vibration coil supports have a 4–5 mm larger design height compared with voice coil carriers which are used in voice coil assemblies according to the first method. Except for the fact that the large design height of the voice coil carrier is also associated with increased weight, this additional design height also acts as an additional spring, so that the application of force onto the diaphragm is negatively influenced. The latter is expressed, in particular, in a deteriorated height reproduction. Regardless of the latter aspects, voice coil assemblies which are produced according to the two known methods have the general disadvantage that a total of three adhesive seams is needed to form them, and specifically for the connection of diaphragm and of the centering membrane to the voice coil carrier and also for attachment of the solder points to the diaphragm and to the voice coil carrier. Therefore the invention is based on the problem of defining a weight-reducing voice coil assembly and also an automated method for its manufacture.

SUMMARY OF THE INVENTION

A voice coil assembly includes a coil carrier having a voice coil with two wire ends. A centering membrane is spaced from the voice coil and is connected to the carrier by an adhesive seam. Two stranded wires are connected to the coil wires at solder points and the solder points are at least partially embedded in the adhesive seam. If the first region of the particular contour of the centering membrane opens up in the direction of the voice coil, and if the solder point is located in the adhesive seam located between the voice coil carrier and the aforementioned region, then the otherwise usual, additional mounting of the solder points is not needed, so that adhesive weight is saved.

If the inside diameter of the diaphragm neck is greater than or equal to the outside diameter of the voice coil carrier, plus at least two times the material thickness of the centering membrane, and if the first region of the contour of the centering membrane is located at least partly between the voice coil carrier and the neck of the diaphragm, then a very compact voice coil assembly with minimum structural height will be created.

BEST MODE FOR CARRYING OUT THE INVENTION

Figure 1A:
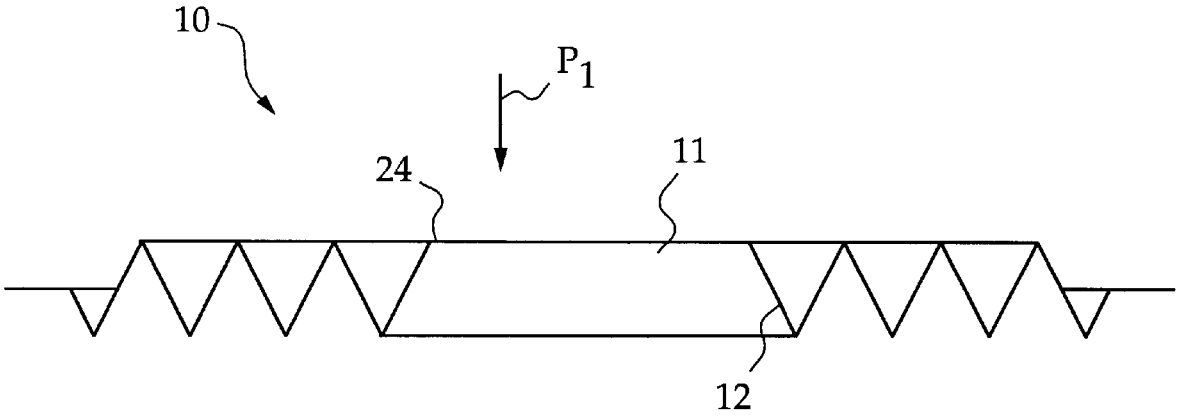
FIG. 1*a* is a cross-sectional view of a centering membrane.

FIG. 1*a* shows a centering membrane 10 in a cutaway presentation. The centering membrane 10 has an accordion-shaped contour and a central opening 11. The region of the centering membrane 10 immediately surrounding the opening 11 is the one which is designated in this application as the first region 12. Since the contour of the centering membrane 10 is of accordion-like design, the first region 12 has a slanting profile relative to the middle line.

Figure 1B:
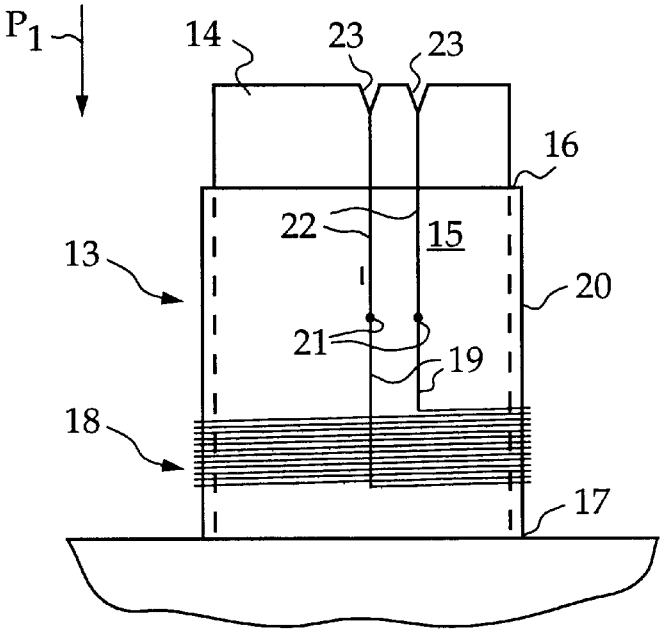
FIG. 1*b* is a front view of a voice coil carrier.

FIG. 1*b* shows a voice coil carrier 13 which is of tubular design. This voice coil carrier 13 is positioned on a working spindle 14 which fills a space 15 surrounded by the voice coil carrier 13 and exits it at the upper end 16 of the voice coil carrier 13. Near the lower end 17 of the voice coil carrier 13 the voice coil 18 is attached to the voice coil carrier 13. The two voice coil wires 19, which are connected to the voice coil 18, are run along the outer casing 20 of the voice coil carrier 13 in the direction of the upper end 16 of the voice coil carrier 13 and, from the center of each of the solder points 21, are electrically connected to the stranded wires 22 also running along the outer casing 20 of the voice coil carrier 13. Attachment of the coil wires 19, of solder points 21, and of the stranded wires 22 to the outer casing 20 of the voice coil carrier 13 was achieved in that the stranded wires 22 were attached and drawn tightly against the notches 23 provided at the upper end of the working spindle 14. The notches 23 are mentioned only as an example. The tightening and attachment of the stranded wires 22 may take place in any other manner currently known to a person skilled in the art.

Figure 2B:
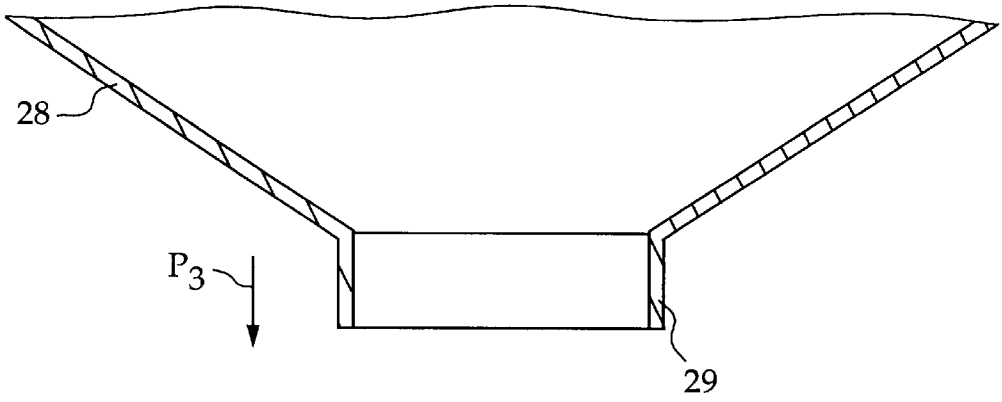
FIG. 2*b* illustrates a diaphragm.
Figure 2A:
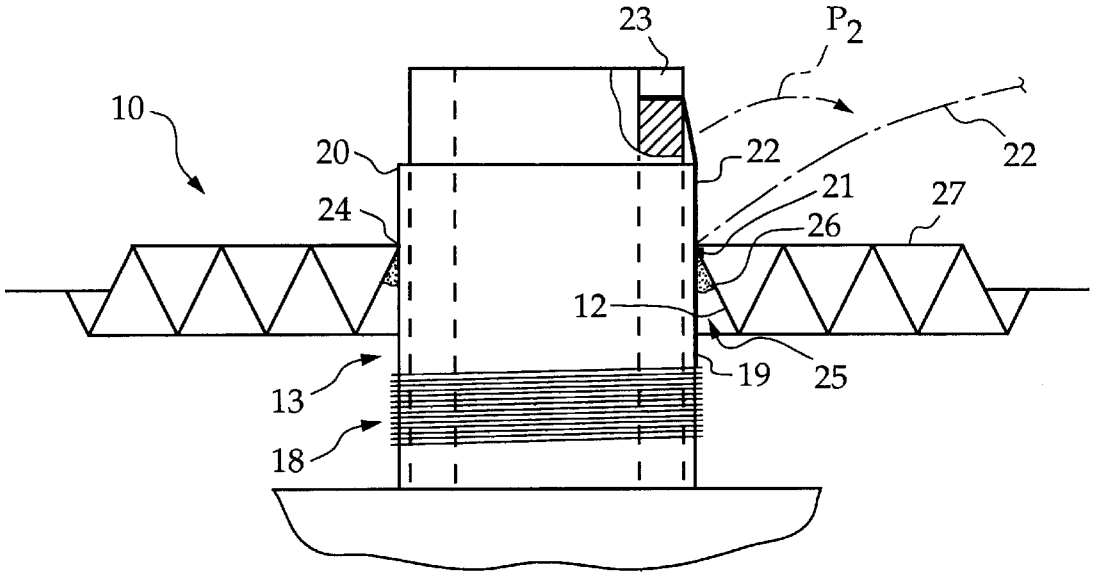
FIG. 2*a* illustrates a voice coil carrier with a centering membrane.

If the centering membrane 10 shown in FIG. 1*a* is pushed in the direction of the arrow P1 at the upper end 16 onto a voice coil carrier 13 according to Figure lb, then the situation shown in FIG. 2*a* will occur. For better clarity of illustration with respect to FIG. 1*b*, in FIG. 2*a* the voice coil carrier 13 has been rotated 90° clockwise. Clearly indicated in the presentation according to FIG. 2*a* is that the inner edge 24 of the centering membrane 10 is resting against the outer casing 20 of the voice coil carrier 13 and the first region 12 of the centering membrane 10 opens up in the direction of the voice coil 18.

Also, it is evident from the representation in FIG. 2*a* that the coil wire 19, the solder point 21, and the stranded wire 22 visible in this display rest against the outer casing 20 of the voice coil carrier 13, since the stranded wires 22 are attached in the shown notches 23 and tightly drawn. The visible solder point 21 is located between the first region 12 of the centering membrane 10 and the outer casing 20 of the voice coil carrier 13.

The adhesion between the voice coil carrier 13, the centering membrane 10, and the conductive point 21 was implemented such that an adhesive seam 26 is formed in the gap 25 between the first region 12 and the outer casing 20 of the voice coil carrier 13. It can be mentioned for the sake of completeness that the adhesive seam 26 can be formed in another design example (not shown), before pushing the centering membrane 10 onto the voice coil carrier 13 or the attachment and tightening of the stranded wires 22 to the voice coil carrier 13. In this case, the centering membrane 10 will then be pushed into the adhesive seam 26.

Once the centering membrane 10 has reached its end position on the voice coil carrier 13 shown in FIG. 2*a* and if the adhesive seam 26 is formed, then the stranded wires 22 should be removed from the notches 23 or they should be passed (in another, not illustrated design example) with the particular tensioning and mounting array in the direction of the arrow P2 arc-like past the upper side 27 of the centering membrane 10. Then, if the adhesive seam 26 hardens, the stranded wires 22 will already have a certain preferred orientation with respect to their future attachment points to the loudspeaker housing (not shown).

A diaphragm 28 is shown in FIG. 2*b* which has a neck 29. If the inside diameter is greater than or equal to the outer diameter of the voice coil carrier 13 and if the diaphragm 28 is lowered onto the voice coil carrier 13 in the direction of arrow P3, then the situation schematically illustrated in FIG. 3 will occur.

Figure 4:
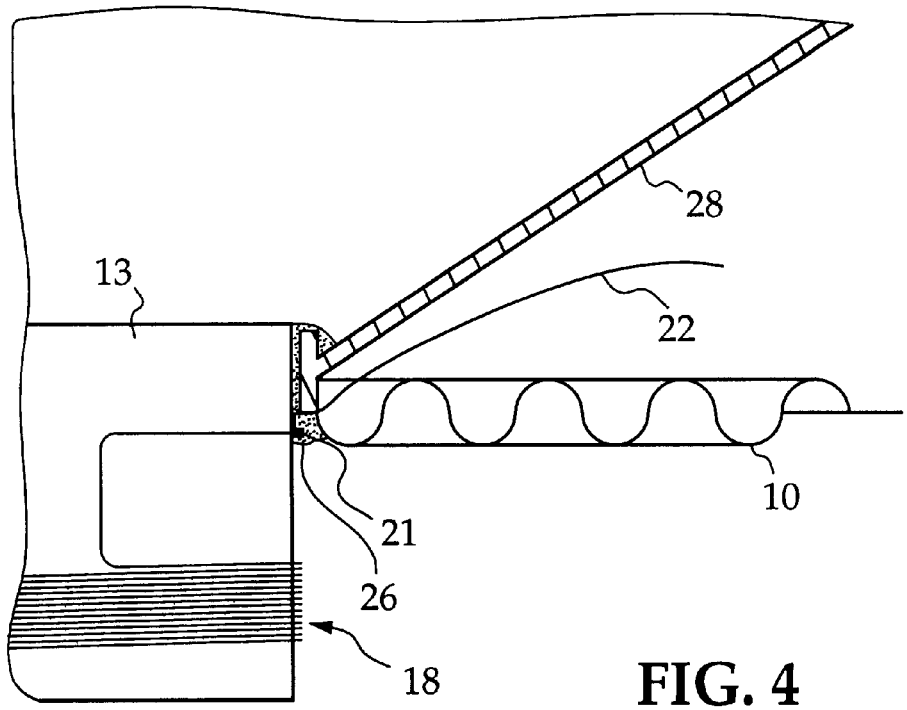
FIG. 4 is another voice coil assembly.

Also schematically illustrated in FIG. 4 is a diaphragm 28 connected to the voice coil carrier 13, but where the centering membrane 10 has a corrugated contour.

Figure 3:
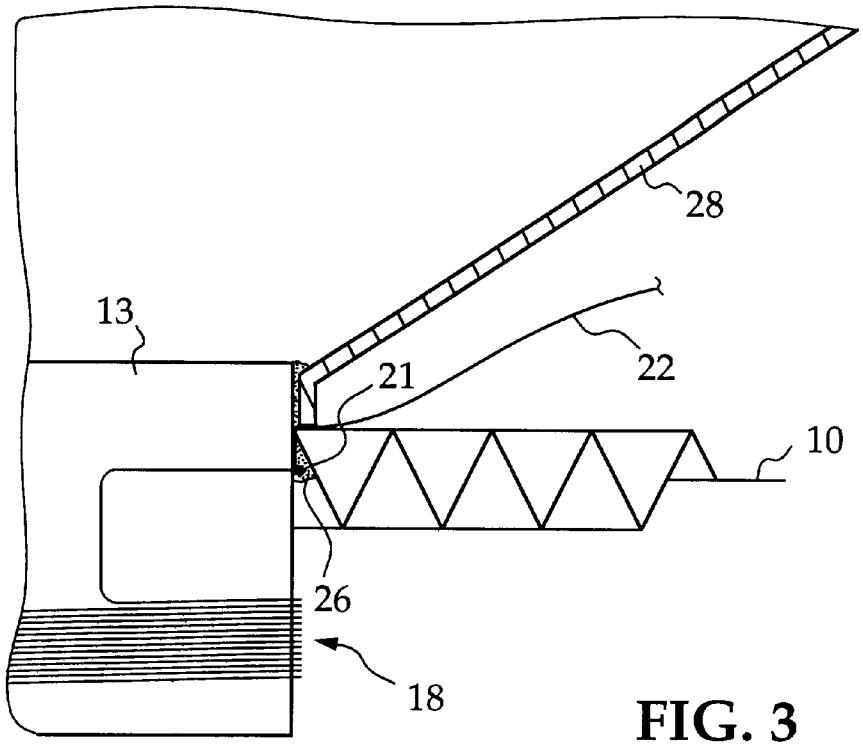
FIG. 3 is a voice coil assembly.
Figure 5A:
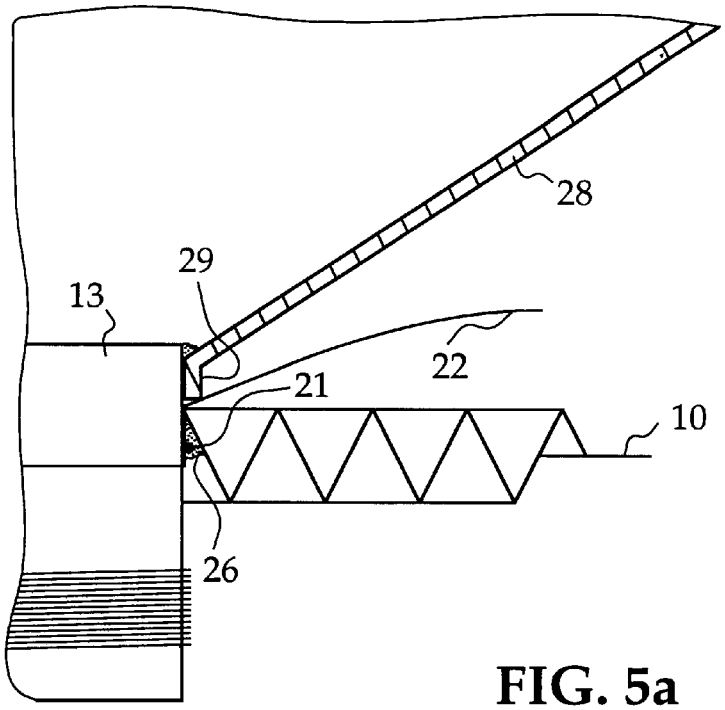
FIGS. 5*a–d* are four detailed representations of a voice coil assembly.

From FIG. 5*a* it is evident that in an arrangement according to FIG. 3, the stranded wire 22 exits between the neck 29 of the diaphragm 28 and the centering membrane 10, and that the neck 29 and the centering membrane 10 are positioned with almost no spacing between each other in the longitudinal direction of the voice coil carrier 13.

Figure 5B:
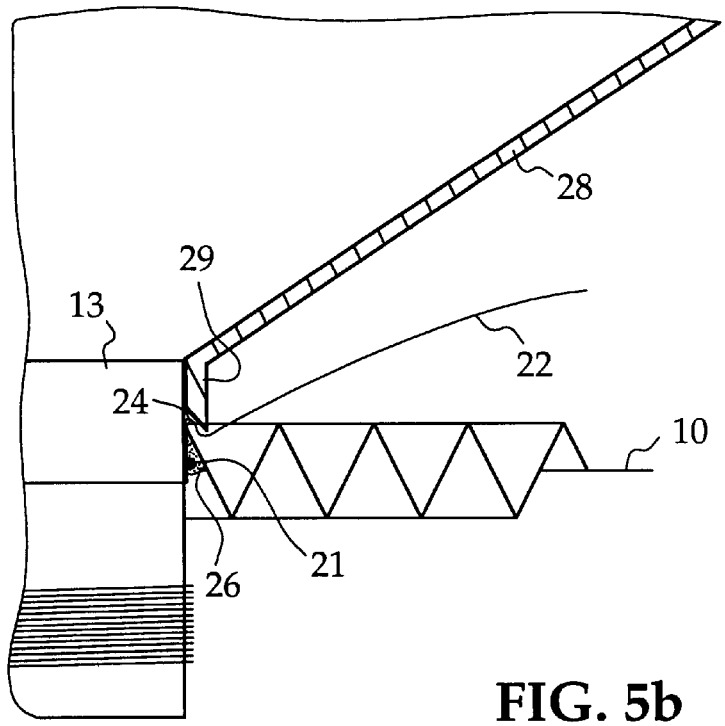

FIG. 5*b*, in which the adhesive seam (26) is not shown (for reasons of conciseness), and in which, for the same reasons, a small spacing is used between the voice coil carrier 13, the centering membrane 10, the solder point 21, and also between stranded wire 22 and the neck 29 of diaphragm 28, shows that when all said parts are present, the solder points 21, the stranded wires 22 and the upper edge 24 of the centering membrane 10 are located between the voice coil carrier 13 and the neck 29 of the diaphragm 28.

Figure 5C:
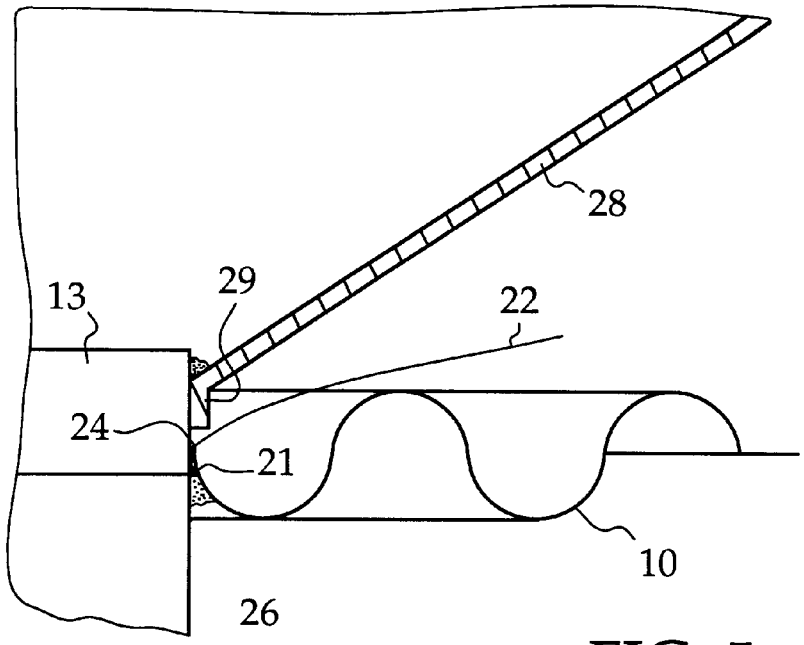

In FIG. 5*c*, in which the centering membrane 10 is of corrugated design, the upper edge 24 of the centering membrane 10 is very close to the neck 29 of the diaphragm 28 in the longitudinal direction of the voice coil carrier 13.

Figure 5D:
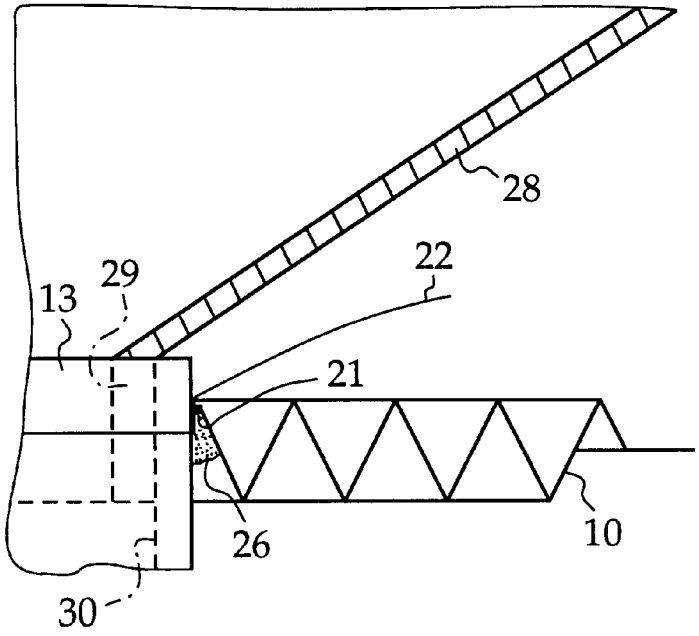

In contrast to this presentation of FIG. 5*a*, in FIG. 5*d* the neck 29 of the diaphragm 28 is attached to the inside 30 of the voice coil carrier 13. Clearly visible in the representation of FIG. 5*a* is that the neck 29 and the adhesive seam 26 are located essentially in the same plane relative to the longitudinal direction of the voice coil carrier 13.

After the voice coils are connected to the voice coil carrier and also the coil wires are connected to the stranded wires via the solder points, the stranded wires above the end of the voice coil carrier, which is to be connected to the diaphragm, are then attached and pulled tight, so that the coil wires (provided they have been previously joined to the voice coil carrier via the baked lacquer connection), the solder points, and stranded wires rest tightly against the voice coil carrier. In this case, the centering membrane, whose inner edge is equal to the outer diameter of the voice coil carrier, can be easily pushed up to the region where the solder points touch the voice coil carrier. At the given diameter ratios of the inner edge of the centering membrane, the stranded wires touching the voice coil carrier do not prevent the diaphragm from being pushed upon the voice coil carrier, since the centering membrane due to its particular contour can escape elastically in the radial direction from the somewhat stiffer stranded wires. If the centering membrane has assumed its end position on the voice coil carrier, then the solder points are located between the first region of the particular contour of the centering membrane and the voice coil carrier, so that to produce a permanent connection of centering membrane, solder points, and voice coil carrier, only one adhesive seam is required in the gap between voice coil carrier and the first region. In other words, because the solder points are located in the gap between the voice coil carrier and the first region of the centering membrane and the stranded wires rest tightly against the voice coil carrier during assembly due to the tension effect, the adhesive seam between centering membrane and voice coil carrier can also be used for attachment of the solder points.

It is very useful for the adhesive seam to be formed before the attachment and tight drawing of the stranded wires, because in this case a particularly good attachment of the solder points to the voice coil carrier can be achieved. If the end of the voice coil carrier, which later is to be connected to the diaphragm, points toward the center of the earth at least during step four, then gravity can be used for uniform distribution of the adhesive in the gap between the voice coil carrier and the first region of the centering membrane. If the voice coil carrier is located on at least one working spindle at least during the execution of steps two to four, then damage to the voice coil assembly during the automatic manufacturing process will be prevented, since due to the working spindle(s), manual handling of the coil is not necessary.

In one particularly favorable process, before the adhesive seam has hardened, the already attached and tightly drawn stranded wires are passed essentially curved over the surface of the centering membrane turned away from the voice coil. This curved guidance of the stranded wires means that the stranded wires will have a preferred orientation with respect to their later course after hardening of the adhesive seam in the region of the connection of voice coil carrier, solder points, and centering membrane.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

What is claimed is:

1. Voice coil assembly with a voice coil carrier 13, with a voice coil 18, which has two voice coil wires 19 and which is attached to the voice coil carrier 13, with a centering membrane 10 located at an axial distance from the voice coil 18, said membrane has a zig zag shaped or corrugated contour which is connected to the voice coil carrier by means of an adhesive seam 26 transverse to the longitudinal extent of the voice coil carrier 13, wherein the adhesive seam 26 is located between the voice coil carrier 13 and a first region 12, located directly opposite to the voice coil carrier 13, of the particular contour of the centering membrane 10, and with two stranded wires 22, which are each connected via one solder point 21 to the two coil wires 19, characterized in that the first region 12 of the particular contour of the centering membrane 10 opens up in the direction to the voice coil 18, and in that the particular solder points 21 are embedded at least partly in the adhesive seam 26.

2. Voice coil assembly according to claim 1, characterized in that a diaphragm 28 is provided which is equipped with a neck 29, and that the neck 29 of the diaphragm 28 is connected to the voice coil carrier 13.

3. Voice coil assembly according to claim 2, characterized in that the inner diameter of the neck 29 is greater than or equal to the sum of the outer diameter of the voice coil carrier 13 and of at least two times the material thickness of the centering membrane 10, and that the first region 12 of the contour of the centering membrane 10 is located at least partly between the voice coil carrier 13 and the neck 29 of the diaphragm 28.

4. Voice coil assembly according to claim 2, characterized in that the outer diameter of the neck 29 is less than or equal to the inner diameter of the voice coil carrier 13 and in that the neck 29 is inserted into and is connected to the inner diameter of the voice coil carrier 13.

5. Voice coil assembly according to claim 4, characterized in that the neck 29 and the adhesive seam 26 have essentially the same axial spacing to the voice coil 18.

* * * * *